US005579870A

United States Patent [19]

Ruttenberg

[11] Patent Number: 5,579,870

[45] Date of Patent: Dec. 3, 1996

[54] WATER-DRIVEN ROBOTS

[76] Inventor: Gideon Ruttenberg, 81-465 Date Palm Ave., Indio, Calif. 92201

[21] Appl. No.: 335,088

[22] Filed: Nov. 7, 1994

[51] Int. Cl.[6] ..... B66B 17/12

[52] U.S. Cl. ..... 187/405; 187/274; 187/275; 187/285; 185/27

[58] Field of Search ..... 187/405, 254, 187/272, 274, 275, 285; 200/83 T, 85, 81 R; 185/27

[56] References Cited

U.S. PATENT DOCUMENTS

| | | | |
|---|---|---|---|
| 1,216,546 | 2/1917 | Caldwell | 187/405 X |
| 3,845,842 | 11/1974 | Johnson | 187/405 X |

FOREIGN PATENT DOCUMENTS

| | | | |
|---|---|---|---|
| 839967 | 6/1981 | U.S.S.R. | 187/405 X |
| 229279 | 8/1925 | United Kingdom | 187/405 X |
| WO92/07787 | 5/1992 | WIPO | 187/405 X |

*Primary Examiner*—William E. Terrell
*Assistant Examiner*—Dean A. Reichard

[57] ABSTRACT

Water driven robots are provided which can be used for moving different objects at different controlled directions and frequencies to obtain energy and power from the flow of a liquid, such as water. A container (10) contains a siphonic outlet which is capable of converting relatively low continuous flow of water, entering through its inlet (17), to a relatively high intermittent pulsating flow of water, ejected from its outlet (23). Such flow is used for moving the robot as follows: During each cycle, water fills the container so that its weight increases, causing the container to move down and move a pulley (65) or other object (73). When the container's liquid level reaches the inlet of the siphon, it rapidly drains and becomes lighter, thereby resulting in a return of the weight. Thus a continuous inflow of liquid causes the container to oscillate vertically and provides force, energy, and power for operating such robots, for controlling their motion, and for operating work loads connected to the robots.

19 Claims, 4 Drawing Sheets

WATER-DRIVEN ROBOTS

BACKGROUND—FIELD OF INVENTION

This invention relates to robots that operate by the energy of water, particularly to such robots that can be used for moving different objects at different controlled directions, speeds, and frequencies. It also relates to the conversion of the energy of moving water to other forms of energy.

BACKGROUND—DESCRIPTION OF PRIOR ART

Conventional robots can perform various complicated functions. These robots consist of one or more electric motors and mechanisms for enabling such motors to control the movement of any of their parts. However they require a supply of electrical energy and thus must be connected to an electric mains or to a battery. If the location where the robot is installed lacks a continuous supply of electrical energy, the robot cannot be operated. E.g., in certain areas, a continuous supply of electrical energy is not available so robots cannot be used there. In other areas, e.g., in wet areas, electricity is dangerous to use. Thus in the latter areas robots cannot be operated, or can't be operated safely.

Turbines of different types have been used since ancient times for converting the energy of flowing water into other forms of energy, e.g., for grinding grains in ancient times and now for use in hydroelectric power plants. The practical applications of such turbines are usually limited to cases in which water can be forced to flow from a relatively high height (head) through such turbines. Such turbines have not been used to perform any function which is more complicated than turning a generator.

Electrical and fluid-driven motors are known, but these generally provide only rotary motion. In many applications it is desirable to provide linear or translatory motion, e.g., to move components from one location to another. To convert rotary motion to a linear motion, mechanical components, such as eccentric cranks and rack and pinion gears, must be used. These are awkward, take space, and have relatively low reliability.

SUMMARY

According to the invention, robots operate from the energy of water can flow from one elevation to a lower elevation. Simple devices are used for converting the energy of water to force which can be used for operating the robot and for controlling the performance of such robots. The robots can be used for moving different objects, for converting energy of water to other useful forms of energy, and for controlling the operation of other devices.

OBJECTS AND ADVANTAGES

Accordingly, several objects and advantages of the present invention are to provide robots: (a) for moving objects at controlled directions and frequencies without dependency on electrical energy, (b) which use the energy of moving water, (c) which can operate in wet areas, and (d) can operate in such areas safely.

Further objects and advantages are (e) to provide a novel and valuable way to transfer the energy required to operate such robots and (f) to connect several such robots to the same or to different pipes, so that each robot can be used for the same or for different applications. Yet further objects are to provide such robots (g) for controlling the operation of other devices at any distance and an elevational difference from a source of water, (h) that can operate by means of a pump that circulates water in a closed system, and (i) for converting substantial amounts of potential energy of water to other forms of energy.

The advantages of such water-driven robots result from (1) the simplicity of their mechanism in which a simple container provides the power and the means for control, and (2) the fact they can be operated directly by the energy of water without converting it to other forms of energy. Moreover they can be used almost at any location by employing simple and inexpensive auxiliary devices.

Yet further objects and advantages of my invention will become apparent from a consideration of the drawings and ensuing description.

DRAWING FIGURES

Figure 2A:
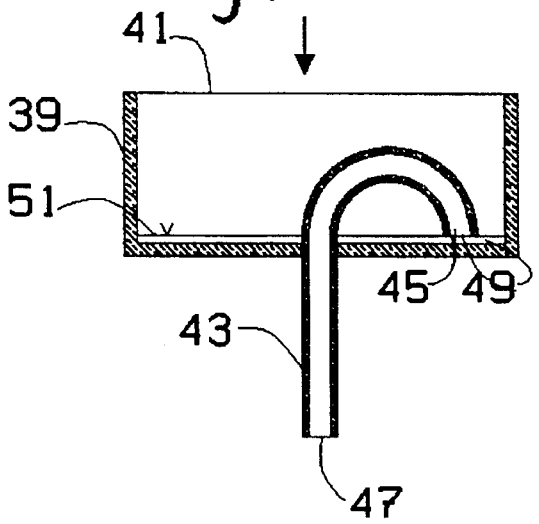
FIG. 2 illustrates another type of container which can be used for creating the required force and can also be used for creating a time delay.

FIG. 2*a* shows the container when liquid is at a low level.

Figure 2B:
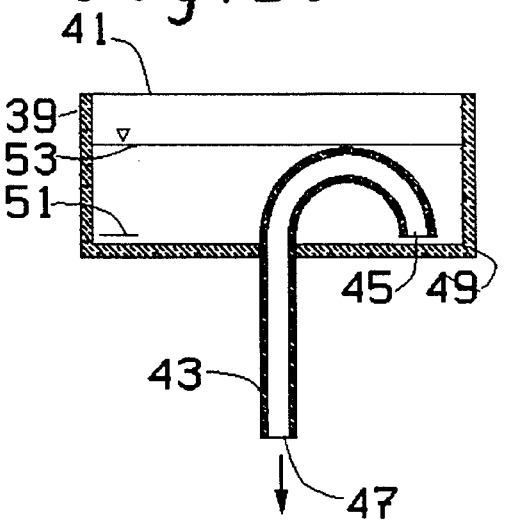

FIG. 2*b* shows the container when liquid is at a high level.

FIG. 3 illustrates the basic concept of a Water-Driven Robot (WDR) in accordance with the invention.

Figure 3A:
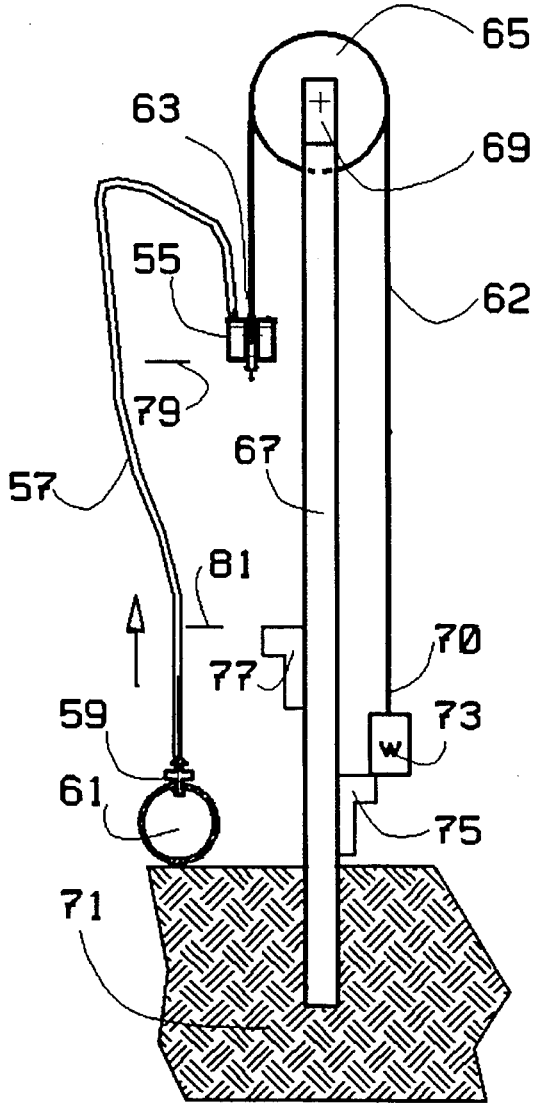

FIG. 3*a* shows the WDR with a container at its high level and an object (W) at its low level.

Figure 3B:
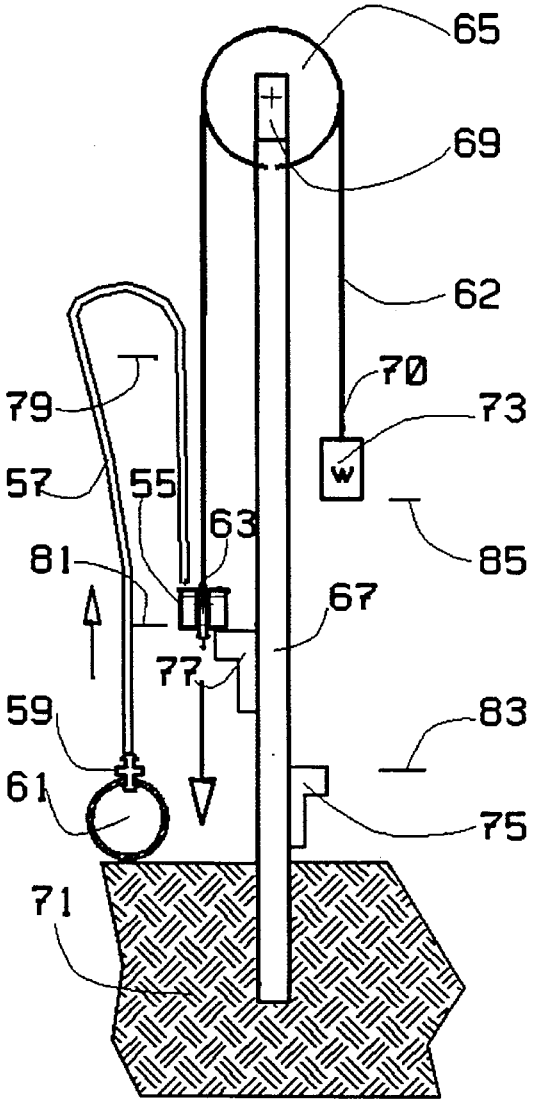

FIG. 3*b* shows the WDR with the container at its low level and the object (W) at its high level.

FIG. 4 shows one application of the WDR in which it is used for periodically moving a traffic stop sign.

Figure 4A:
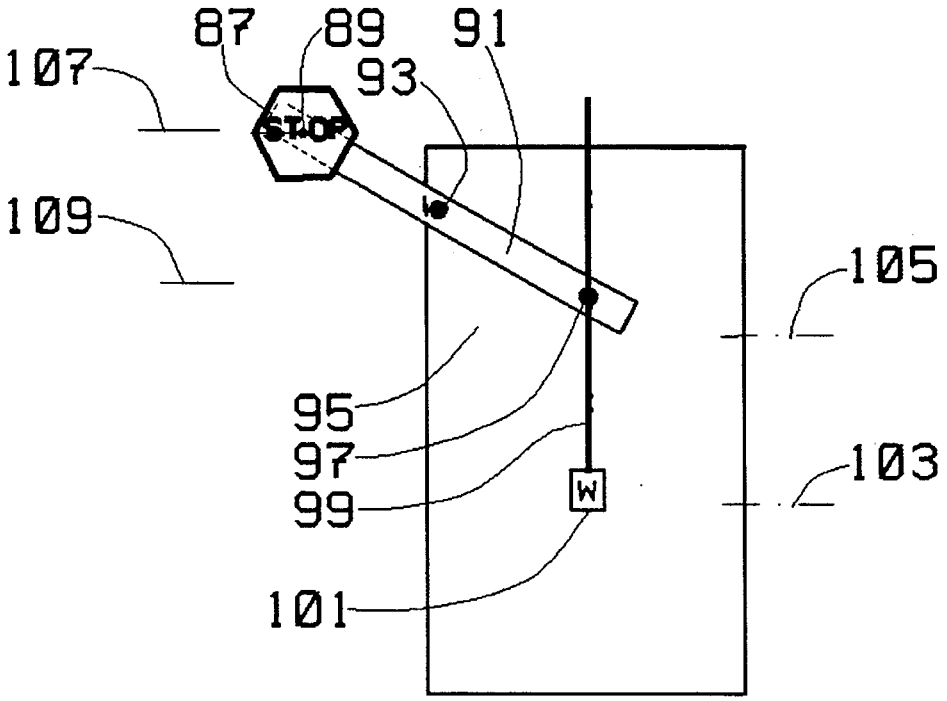

FIG. 4*a* shows the WDR with a stop sign at its high level.

Figure 4B:
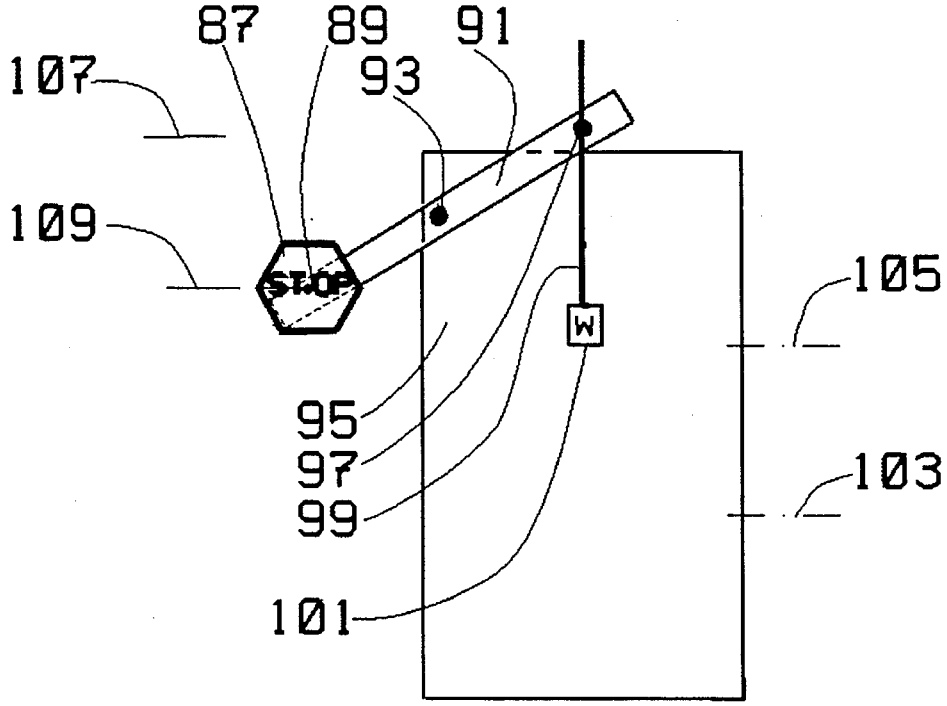

FIG. 4*b* shows the same WDR with the same stop sign at its low level.

FIG. 5 illustrates the basic concept of this invention for controlling time, time delays, on-and-off times frequencies, and other similar factors.

Figures 5A, 5B, 5C:
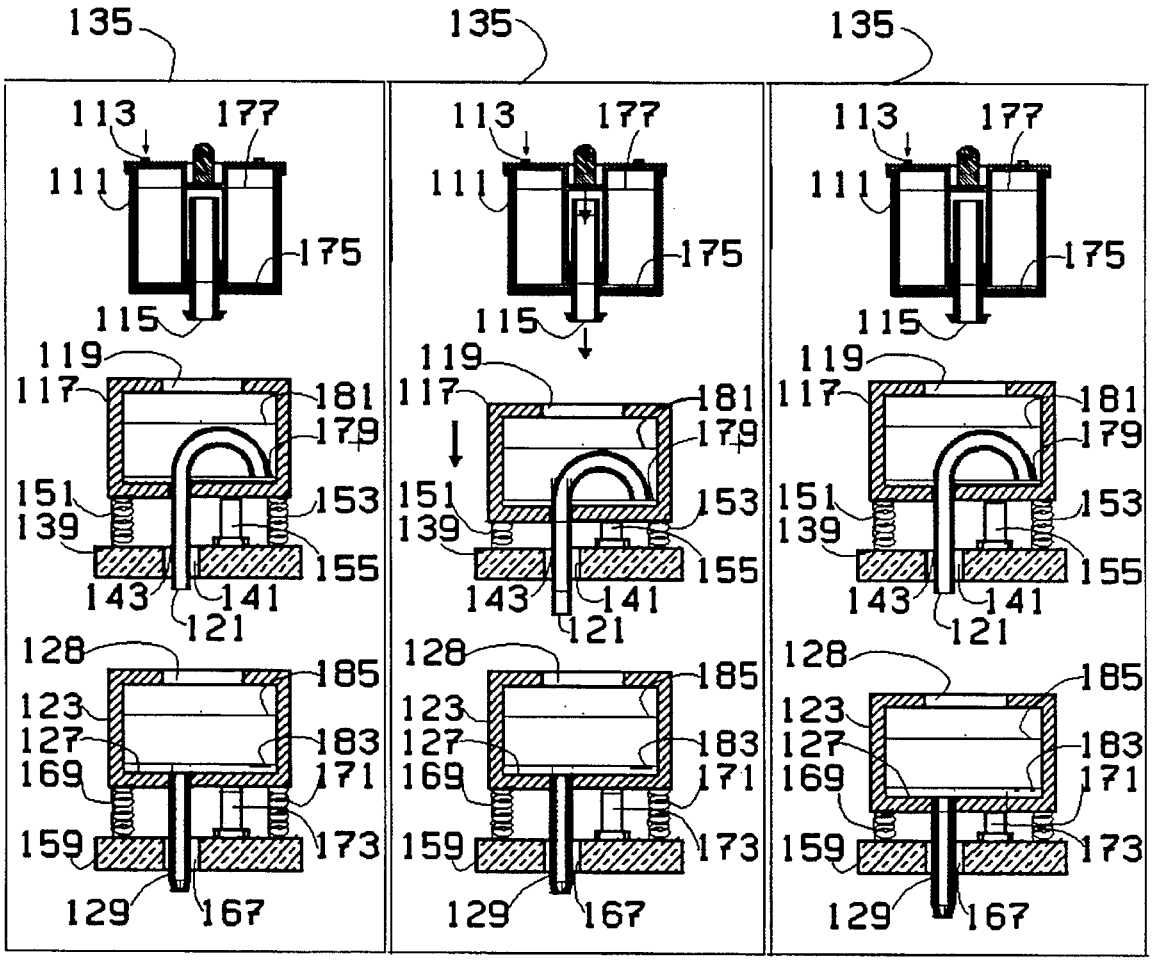

FIGS. 5*a*, 5*b*, and 5*c* show a device with three containers which are connected to a board so that when the top container is full of water, the water flows out from the top container to the middle container and then, when the middle container is full, the water from the middle container flows to the bottom container, and out from the device.

FIG. 5*a* shows the three containers at the stage in which top container fills up with water.

FIG. 5*b* shows the three containers at the stage in which middle container is full of water and its weight causes it to move down, pushing down the middle electric switch.

FIG. 5*c* shows the three containers at the stage in which bottom container is full and its weight causes it to move down, pushing down the bottom electric switch.

Figure 6:
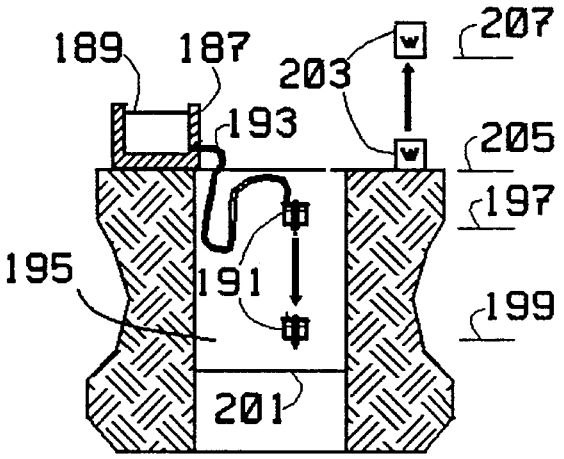

FIG. 6 illustrates a WDR being fed from a water canal at ground level.

DETAILED DESCRIPTION OF THE PRESENTLY-PREFERRED EMBODIMENT

Figure 1:
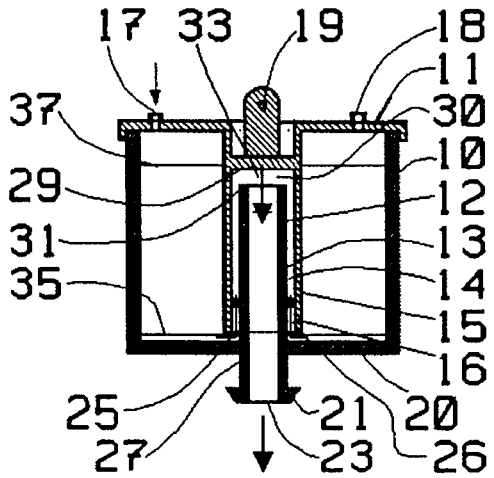
FIG. 1 illustrates one type of a container used in this invention to create the force for operating robots.

FIG. 1—Siphonic Container—Description

FIG. 1 shows a cross-sectional view of one type of device, a siphonic container, designated Type A, which is used for creating the force for operating a robot in accordance with the invention. The device comprises a container 10 having a lid 11, both preferably made of plastic. Container 10 and lid 11 are shown in cross section and have a circular configuration (not shown) when seen from above. Container 10 has a bottom or floor 20, a circular side wall, and an open top which is covered by lid 11. Lid 11 has a rim extending down slightly around the top of the container.

Lid 11 has an upwardly projecting input or inlet nipple 17 which serves as a water inlet to container 10. Nipple 17 preferably has a barb (not shown) for securely holding a hose (not shown) which is fitted thereover. Lid 11 also has a hole 18 for venting container 10. An integral cylinder 15 extends down from the flat underside of a circular depression or well in the center of lid 11. Cylinder 15 has an inside diameter 16 and extends axially through container 10 almost to the bottom 27 of container 10. The space between the bottom of cylinder 15 and bottom 27 of container 10 constitutes a space or inlet 25. The upper side of the central depression in lid 11 has an upwardly extending flat tab with a hole 19 for hanging the device.

The center of the bottom of container 10 has an integral tube 12 extending up therefrom. Tube 12 has an inside diameter 13 and an outside diameter 14. The upper portion of tube 12 inside container 10 extends coaxially within cylinder 15 and is separated therefrom by a cylindrical, coaxial space 26. Tube 12 has a lower portion or extension 27 which projects downwardly from the bottom of container 10. Extension 27 has a barb 21 at its lower end. The extension can be used for connecting a further tube (not shown) or an additional extension if required; the barb holds the tube from slipping off. The bottom or lower end of tube 12 constitutes a water outlet 23. The upper end 31 of tube 12 (inside cylinder 15) constitutes a water inlet 33 and is positioned by a space 30 from the top 29 of cylinder 15.

The container of FIG. 1 (and FIG. 2, described infra) may have any volume, dimensions, and shape.

FIG. 1—Operation

If water is fed into container 10 via inlet 17, its elevation inside container 10 changes gradually from a low level 35 to a high level 37. As it rises, the water flows through inlet 25 at the bottom of cylinder 15 and up through space 26 between cylinder 15 and tube 12. When the water level reaches space 30, it will flow down into tube 12. As the water flows down in tube 12, it fills tube 12 and its weight creates a siphonic or vacuum action which in turn creates suction in space 26. This then causes the water in container 10 to flow continuously at a relatively high rate up space 26, into space 30, down through tube 12, and out through outlet 23. This siphonic action empties the water from container 10 in a relatively rapid manner, reducing the water down to low level 35.

FIGS. 2*a* And 2*b*—Alternative Siphonic Container—Description

FIGS. 2*a* and 2*b* show a view, partly in cross section, of another or alternative siphonic container, Type B, capable of performing in a similar manner to that of FIG. 1. Container 39 of FIGS. 2 has an open top 41 and a siphon tube 43 having an inside diameter of about 8 mm and a water inlet 45 and a water outlet 47. Tube 43 extends through the center of the bottom 49 of container 39 and then down so that outlet end 47 is below the bottom 49 of the container. The opposite or bight end of tube 43 is inside the container and extends up from the container's bottom and then curves down to terminate in inlet end 45, which is spaced slightly above the container's bottom. The middle of the bight portion of the tube is, in effect, an inlet portion of the tube.

The portion of the tube to the right of the middle of the bight portion is, in effect, a passageway leading to this inlet portion, even though it is integral and continuous with the rest of the tube. This passageway (the descending end of the tube to the right of the bight portion) provides the same function as the cylindrical space between tube 12 and cylinder 15 of FIG. 1, i.e. provides a conduit or passageway to adjacent the bottom of the container so that when the water level reaches the inlet portion and siphonic action starts, the siphonic action will be able to drain substantially the entire container.

FIGS. 2*a* And 2*b*—Operation

If water flows continuously into container 39 through its open top 41, the level of the water in container 39 will increase from a low level 51 (FIG. 2*a*) to a high level 53 (FIG. 2*b*). During this time the water will flow into inlet end 45 of tube 43 and fill the tube. Due to surface tension, no matter how slowly water flows into this container, no water will flow out of tube 43 until the water level reaches level 53, above the lower side wall of the middle of the bight portion of tube 43. When the water reaches high level 53, it will flow through tube 43 and then down the tube and out through outlet 47. This will create a siphonic action which will rapidly eject all the water in the container down to level 51 at a high flow rate.

The above cycle will repeat as long as water flows into container 39.

Thus container 39 will convert a low continuous flow of liquid to a high, intermittent pulsating flow. A special important group of such siphonic containers have siphon tubes with inside diameters of about 6 to 10 mm.

Examples

The following examples show how the containers of Types A and B perform with various parameters.

Example 1:

If the continuous low flow entering the container has a value of only 0.10 liter per hour and the container has a volume of one liter, it will take about 10 hours to fill the container to high level 53. Then water will eject from the container at a high flow rate of about 100 liters/hour, taking about 1/100 of an hour (36 seconds) to empty. The cycle time of such a container is about 10 hours.

When using a continuous inflow of 20 liters/hour, it will take only three minutes to fill the same one-liter container. Such a container will operate with a cycle time of about 3 to 4 minutes.

With a inflow of 20 liters/hour and a container with a volume of only 0.33 liter, it will take only one minute to fill the container, and the cycle time will be even shorter.

The required time for draining such container is correlated to several factors, including the container's volume, the average ejecting flow, etc.

When the weight of an empty container is W1 and its volume is V1, and the liquid is water, the weight W of the container will gradually change from W1 to W2 in which W2 is the weight of the container when it is full of water.

Example 2:

Assume W1=0.1 Kg, V1=1 liter, and W2=1.1 Kg. The weight of the container will gradually change from 0.1 Kg, when it is empty, to 1.1 Kg, when it is full. The cycle time of this change in weight is the same as the cycle time to fill and eject water from the container.

FIGS. 3*a* And 3*b*—Basic Water-Driven Robot—Description

FIGS. 3*a* and 3*b* illustrate two views, partly in cross section, which show a water-driven robot (WDR) in accordance with the invention.

A Type A container 55 (FIG. 3*a*) is continuously fed from the distal (upper) end of a flexible water supply tube 57 which has a proximal (lower) end connected by means of fitting 59 to a water supply pipe 61. An end 63 of a cord 62 is connected to a hole 17 on container 55. Cord 62 is dressed around a pulley 65 which is connected to a pole or edge of a wall 67 by means of a plate or bracket 69. Pole or wall 67 is inserted into or mounted on the earth, ground, or any other mount 71 and is held firmly thereat. The other end 70 of cord 62 is connected to an object or counterweight (indicated by "W") 73. Pole 67 has two spaced stop blocks 75 and 77 mounted thereon. Container 55 and object 73 move on respective sides of pole or wall 67.

FIGS. 3*a* And 3*b*—Operation

Assume that container 55 is located at upper level 79 and that water flows into container 55 from pipe 61 via tube 57. The container's weight will gradually increase until it becomes heavier than object 73, which is located at a low level 83. This causes container 55 to move down towards a low level 81, causing cord 62 simultaneously to pull object 73 up towards high level 85 (FIG. 3*b*).

When the water reaches a high level in the container (similar to level 37 of FIG. 1), the water will rapidly drain from the container due to the aforedescribed siphonic action. This will reduce the weight of the container, causing it to move rapidly back up to level 79 (FIG. 3*a*).

As long as water continues to flow into container 55 at a relatively low rate, it will be ejected from the container in intermittent pulses of a relatively high flow rate. This will cause object 73 and container 55 repeatedly to move down and then up. Such vertical oscillations will occur at the same frequency at which the pulses of water flow out from container 55.

The upper and lower limits of vertical movement of the container and object 73 are limited by stops 75 and 77.

Assume that container 55 has a weight W1 when it is empty, a weight W2 when it is full of water, and object 73 has a weight W3. Also assume that W3 is heavier than W1 and lighter than W2. Then as long as water flows into container 55 and is ejected at a higher pulsating flow, object 73 will move up and down at the same pulsating cycle at which water flows in and out from container 55. The maximum force F1 created due to these changes of weight is F1=W2−W3. If W4 is the weight of water in container 55 when it is full, then W2=W1+W4 and the magnitude of force F1 can be calculated from the following formula: F1=(W1−W3)+W4.

Example 3:

Assume that W1=0.1 Kg, W3=0.2 Kg, V=2 liters. (F1=(0.1−0.2)+2=1.9 Kg)

When container 55 is empty, object 73 is heavier (0.2>0.1). Therefore object 73 moves down, pulling up container 55. When container 55 is full, it pulls up object 73 with a net force F1=1.9 Kg.

If stop 77 is a permanent magnet which can hold a weight of 1.8 Kg and container 55 contains iron, then object 73 will not move down before container 55 is filled with water, creating a net force F1 higher than 1.8 Kg. In such a case, container 55 and object 73 will not move until enough water accumulates in container 55.

In a similar way, a permanent magnet stop (not shown) can be used to hold container 55 at its high elevation, so that the container will not move before it is full.

Instead of using a flexible tube 57, water can drip or flow into container 55 from a pipe (not shown) having a fixed outlet above high level 79.

FIGS. 4*a* And 4*b*—Water-Driven Stop Sign—Description

FIGS. 4*a* and 4*b* illustrate one application of the WDR where it is used to cycle a traffic stop sign continuously from a low position to a high position to attract attention.

Stop sign 87 (FIG. 4*a*) is connected by pin 89 to arm 91. Pin or pivot 93 pivotably connects arm 91 to board 95. Arm 91 is also connected at point 97 to a string or cord 99 which is connected to an object or weight 101. Object 101 is at a low elevation 103 and sign 87 is at a high elevation 107. The rest of the WDR is not shown, but is similar to that of FIGS. 3 and it is mounted behind board 95, with its pulley 65 behind and connected to pivot 93.

FIGS. 4*a* And 4*b*—Water-Driven Stop Sign—Operation

In operation, the container behind board 95 causes object 101 to oscillate up and down, as with object 73 of FIGS. 3. Pivot 93 will concomitantly rotate counterclockwise and clockwise in cycles, similar to pulley 65 of FIG. 3. This will cause sign 87 to cycle up and down.

The WDR thus cycles object 101 up from a low elevation 103 (FIG. 4*a*) to a higher elevation 105 (FIG. 4*b*), forcing sign 87 to move down from elevation 107 (FIG. 4*a*) to a lower elevation 109 (FIG. 4*b*). Then sign 87 moves back up to its higher elevation 107 (FIG. 4*a*)

Note that the vertical force can be used for rotating an arm clockwise and then counterclockwise in cycles.

For many applications like this, a sign moving at high frequency may attract more attention. For this purpose, a container with low volume and water that enters the container at higher rates of continuous flow is suitable.

Small size containers (and force) can be used for moving such objects that have low weight.

A group of WDRs as illustrated, each moving one or more signs, which can be the same or different signs, can be connected to a small size water supply pipe and replace people in a demonstration.

A group of mannequins or display signs in a department store can be connected by means of pipes and a pump in a closed system so that each mannequin moves its hands, or other parts, in a different way.

A camcorder (or just its lens) can be connected to the arm of the WDR so as to cause the camcorder to pan left and then right repeatedly to scan a wider area than the camcorder can see in a fixed position. Similarly, the WDR can cause a radar or sonar antenna to pan in cycles.

FIGS. 5*a* To 5*c*—Multiple Timer—Description

FIGS. 5*a* to 5*c* illustrate in a view, partly in cross section, of some of the basic elements used in this invention for providing multiple time delays, on and off times, frequencies, etc.

As shown in FIG. 5*a*, a top container 111 (Type A) is mounted on a board 135 above a middle container 117 (Type B), which is in turn mounted above a bottom container 123. Top container 111 is slowly filled with water via its inlet 113 from a hose or the like (not shown). When it is nearly full, water is rapidly ejected from its outlet 115 by the rapid siphonic action aforedescribed. The water flows into middle container 117 through open top 119.

When middle container 117 is nearly full, water flows out through its outlet 121 into bottom container 123 through the latter's open top 128. Container 123 has at its bottom 127 an outlet tube 129 for controlling its effluent flow rate.

Container 117 is located above a shelf 139 which has a hole 141 therethrough so that siphon tube 143 can pass and move freely therethrough. Container 117 is supported by springs 151 and 153. An electric, spring-loaded pushbutton switch 155 is mounted on shelf 139.

Similarly, container 123 is located above a shelf 159 which has a hole 167 therethrough so that tube 129 can pass and move freely therethrough. Container 123 is supported by springs 169 and 171. An electric, spring-loaded pushbutton 173 is mounted on shelf 159.

FIGS. 5*a* To 5*c*—Operation

Assume that water is supplied into container 111 and it fills in time T1, i.e., the water rises from low level 175 to high level 177. When container 111 is full (level 177), the container rapidly empties its water into middle container 117 (FIG. 5*b*).

When the middle container becomes filled (level 181), its siphonic action will occur and its water will rapidly empty into bottom container 123 (FIG. 5*c*), leaving the water at low level 179. The filling and drain time of middle container 117 will occur in a time T2.

Outlet tube 129 of the bottom container controls the outflow of water therefrom. Assume that it takes a time T3 to empty all of its water.

During time T2, the weight of middle container 117 will become heavy enough to push down springs 151 and 153 and turn on switch 155.

During time T3, the weight of container 123 will become heavy enough (rising from level 183 to level 185) to push down springs 169 and 171 and turn on switch 173.

Switches 155 and 173 will stay on until container 111 is filled again to start a new cycle. This causes containers 117 and 123 to move down, pushing switch 155 to the off position.

When the volume between elevations 179 and 181 in middle container 117 is larger than the volume between elevations 175 and 177 in container 111, a few pulsating cycles of ejection of water from container 111 into container 117 will be required to fill container 117.

It will be seen that by controlling several simple factors, i.e., the rate of flow of water into container 111, the volume of each container, and the size of the outlet tube of the bottom container, different on and off times and different time delays of the two switches can be achieved.

Further, two or more control boards of the type shown in FIG. 5 can be installed in series (one above the other) for controlling more complicated systems.

By using the same logic, the difference in the weights of the containers can be employed for turning valves and many other devices on and off.

FIG. 6—Using Water At Ground Level For Operating Robot—Description

FIG. 6 is a view, partly in cross section, illustrating the WDR of FIG. 3 operating by water from an above-ground or surface canal. The system of FIG. 6 is used to move a weight from one elevation to a higher elevation.

A flexible water supply tube 193 is connected to an above-ground or surface canal 187 which contains water at level 189. The canal and tube continuously feed water into container 191 in a manner similar to that of FIG. 1. The container is mounted in a hole or well 195 in the ground with a rope and pulley similar to that of FIG. 3*a* (not shown). Container 191 can move up and down as in FIGS. 3*a* and 3*b*. One end of the rope (not shown) is connected to container 191 and the other end is connected to an object or weight 203 located at a low elevation 205 above ground.

FIG. 6—Operation

Water from canal 187 flows through tube 193 into container 191. When container 191 becomes heavier than object 203, container 191 moves down from its high elevation 197 to a lower elevation 199, causing object 203 to move up from low elevation 205 to high elevation 207. Water from container 191 drains to a lower water level 201. The weight of container 191 becomes lighter than the weight of object 203 and container 191 moves back up from low elevation 199 to high elevation 197. At the same time object 203 moves down from high elevation 207 to low elevation 205.

By employing a suitable pulley mechanism, object 203 can be lifted up regardless of its initial elevation or the elevation of the canal and ground hole 195. Thus the same displacement of container 191 can be used to lift object 203 from the roof of a house to an even higher elevation. Any liquid, including drainage water, sewage, or waves in the ocean, can be used to operate the robot, so long as the liquid can flow from one elevation to a lower elevation.

Energy And Power

The potential energy (E) of a mass of water (M) located at a relative height (H) is:

$$(E)=g\times M\times H$$

where g is the value of the gravity accelerating 9.8 m/sec.$^2$

Example 4:

For M=1,000,000 metric tons (one cubic meter of water) and for H=10 meters, E=9.8×1,000,000×10=98,000,000,000 joules (watt-sec)=27,200 kwh. At a market value of $0.06/kwh, the value of this quantity of energy (E) is $1,632.

Power (P) is by definition the rate of energy (E) in a unit time (t) or P=E/t.

For M=1 Kg, H=10 meter and t=2 seconds $$P=g\times M\times H/t=9.8\times 1\times 10/2=49 \text{ watts}$$

A force F1=1 Kg can create a power of 49 watts by forcing an object to travel a vertical distance of 10 meters in 2 seconds.

In the WDR illustrated in FIG. 3, if T1 is the required time for filling the container, T2 is required time for the container to travel the vertical distance H when it is full and it moves down, T3 is the required time for draining the container, and T4 is time the container to move up to its original high elevation, then the cycle time T of such a process is $$T=T1+T2+T3+T4.$$

For an economical and a highly efficient system, several WDRs can be used and operate in parallel or in series. so that at any given time T, one of the WDRs will produce power or energy, continuously using the flow of water from the source into the system.

In a preferred system, during the filling time T1, each of the containers can be held at its high elevation, using a magnetic stop or any other means. This eliminates the need for a flexible water supply tube. During the ejecting time T3, each of the containers remains at its low elevation. Water from the source will flow in a synchronized way to each container.

These three functions of the WDRs can be achieved by using the method and simple elements described in connection with FIG. 5, or by adding other elements as may be required.

Conclusion, Ramifications, Scope

The reader will thus see that I have provided a robotic device which can move objects at controlled directions and frequencies without dependency on electrical energy, which uses the energy of water, which can operate in wet areas, and can operate in such areas safely without electricity, which can perform complicated and useful timing functions, which provides a novel and valuable way to transfer the energy required to operate such robots, which can be connected together to the same or to different pipes, so that each robot can be used for the same or for different applications, which can control the operation of other devices at any distance and elevational difference from a source of water, which can operate by means of a pump that circulates water in a closed system, which can convert substantial amounts of potential energy of water to other forms of energy, and which can lift weights. Yet my mechanism is simple, reliable, inexpensive and can be operated directly by the energy of water without converting it to other forms of energy.

While the above description contains many specificities, these should not be construed as limitations on the scope of the invention, but as exemplifications of the presently-preferred embodiment thereof. Many other ramifications and variations are possible within the teachings of the invention.

For example, the sizes, materials, and shapes of the containers can be changed. The method of filling of the containers can be changed. E.g., a container can be positioned so that a flood condition will actuate a container and its motion will turn off a valve to stop the flood condition. The movement of the WDR can be used to control and move many different objects or systems. Liquids other than water can be used to fill the container. The containers of Types A and B (FIGS. 1 and 2) with siphons can operate at any minimum flow greater than zero with a siphon tube size of 8 mm internal diameter. Such devices are limited to a maximum flow of about 100 liters per hour. If the user desires to convert substantial amounts of energy, only larger containers can be used. These containers can have either a large siphon tube or no siphon tube. In order to use a container with no siphon, the following conditions should be met: (a) the container should be held at its high elevation when it is full, (b) the container should be drained at its low elevation and returned empty to its high elevation for a new cycle, (c) a valve should be arranged to supply water to the container when it is at its high elevation and turned off when the container starts to move down this can easily be arranged, and (d) a simple valve should be provided and arranged to drain the container when it is at its low level. The WDR can be used in "water sculptures" of the type which recirculate water in order to move various parts of the sculpture in an artistic fashion. In another application, the WDR can be used in a toilet (or sink) to receive urine (or leaking or dripping water) and in response to the filling of a container with such liquid, move a sign which reminds personnel to wash their hands, turn off the faucet, flush the toilet, etc.

Thus the scope of the invention should be determined by the appended claims and their legal equivalents, and not by the examples given.

I claim:

1. A robot that operates by energy of liquid that flows from one elevation to another, lower elevation comprising:

a container having a liquid inlet and a liquid outlet, said container being able to move in a vertical direction in response to a change in the weight of said container, syphon means for converting a continuous flow of liquid entering said liquid inlet of said container at a low flow rate to an intermittent flow ejected from said liquid outlet of said container at a higher flow rate, and connecting means for connecting said container to a source of liquid for supplying said continuous flow of liquid to said container, whereby said container will move up and down in a cyclic movement in response to said continuous flow of liquid thereinto.

2. The robot of claim 1, further including a device connected to said container so that said device moves in response to the movements of said container.

3. The robot of claim 2 said device comprises a flexible elongated member, a pulley, and a counterweight, one end of said flexible elongated member connected to said container, the other end of said flexible elongated member connected to said counterweight, and said flexible elongated member being dressed over said pulley.

4. A robot according to claim 1, further including at least on object whose weight is heavier than the weight of said container when said container is empty and lighter than said container when said container contains at least some of said liquid, and means for connecting said object to said container such that said object will move due to the force created by the weight of said liquid that flows into and out from said container.

5. A robot according to claim 1, further including means for stopping the movement of said container.

6. A robot according to claim 1, further including a second container similar said first-named container, said second container having a liquid inlet to receive liquid from said liquid outlet of said first-named container so as to create a time delay.

7. A robotic system according to claim 6, further including a third container having an input connected to receive liquid from said liquid outlet of said second container and having an output, said third container being able to move vertically.

8. A robotic system according to claim 6, further including a plurality of electrical switches responsive to the motion of said first-named and second containers.

9. The robot of claim 1 wherein said converting syphon means comprises a tube having an open top end, said tube extending vertically up from a floor of said container and having an open bottom communicating with a space below said container, a cylinder concentrically surrounding said tube and extending down from a top of said container, said cylinder having a closed upper end and an open bottom end adjacent but spaced from said floor of said container.

10. The robot of claim 1 wherein said converting syphon means comprises a tube having an open top end, said tube extending vertically up from a floor of said container and bending around at a bight portion thereof so that said open top end is adjacent but spaced from said floor of said container and is below said bight portion.

11. The device of claim 2, further including a sign connected to said container, whereby said sign will move up and down in a cyclic movement in response to said continuous flow of liquid into said container.

12. A device for converting the energy of flowing liquid to oscillatory vertical translatory energy, comprising:

a container having a bottom and walls extending up from said bottom, said container being free to move in a vertical direction, a siphonic tube in said container which has a lower end extending out of said bottom of said container, said siphonic tube having am upper inlet adjacent a top portion of said container, and a passageway communicating with said upper inlet and leading down to adjacent said bottom of said container whereby said container will move up and down in cyclic movement in response to said continuous flow of liquid thereinto.

13. The device of claim 12 wherein said passageway is an extension of said siphonic tube.

14. The device of claim 12 wherein said passageway is a cylinder surrounding said siphonic tube, said cylinder concentrically surrounding said tube and extending down from a top of said container, said cylinder having a closed upper end an open bottom end adjacent but spaced from said floor of said container.

15. The device of claim 12, further including a member connected to said container so that said member moves in response to the movement of said container.

16. The device of claim 15 wherein said member comprises a flexible elongated member, a pulley, and a counterweight, one end of said flexible elongated member connected to said container, the other end of said flexible elongated member being dressed over said pulley.

17. The device of claim 12, further including at least one object whose weight is heavier than the weight of said container when said container is empty and lighter than said container when said container contains at least some of said liquid, and means for connecting said object to said container such that said object will move due to the force created by the weight of said liquid that flows into and out from said container.

18. The device of claim 12, further including means for stopping the movement of said container.

19. The device of claim 12, further including a second container similar said first-named container, said second container having an input connected to receive liquid from said lower end of said siphonic tube so as to create a time delay.

* * * * *